US005261794A

United States Patent [19]

Kamino et al.

[11] Patent Number: 5,261,794

[45] Date of Patent: Nov. 16, 1993

[54] FLUID PRESSURE FEEDING APPARATUS

[75] Inventors: Yukishige Kamino, Tsuchiura; Kenji Uchida, Kashiwa; Makoto Saito, Ibaraki, all of Japan

[73] Assignee: Hitachi, Ltd., Tokyo, Japan

[21] Appl. No.: 670,283

[22] Filed: Mar. 15, 1991

[30] Foreign Application Priority Data

Mar. 16, 1990 [JP] Japan ..... 2-64194

[51] Int. Cl.[5] ..... F04F 1/06; E03B 1/00

[52] U.S. Cl. ..... 417/65; 417/122; 137/624.2; 405/130

[58] Field of Search ..... 417/65, 122, 54; 137/624.11, 624.15, 624.2; 405/130

[56] References Cited

U.S. PATENT DOCUMENTS

| | | | |
|---|---|---|---|
| 3,428,072 | 2/1969 | Welch | 137/624.11 |
| 4,037,992 | 7/1977 | Uchida | 417/103 |
| 4,321,016 | 3/1982 | Sakamoto | 417/103 |
| 4,854,783 | 8/1989 | Uchida | 417/102 |
| 4,922,433 | 5/1990 | Mark | 137/624.2 |
| 4,991,998 | 2/1991 | Kamino | 405/130 |

FOREIGN PATENT DOCUMENTS

| | | |
|---|---|---|
| 2457943 | 6/1976 | Fed. Rep. of Germany . |
| 3129090 | 3/1983 | Fed. Rep. of Germany . |
| 3040283 | 9/1985 | Fed. Rep. of Germany . |
| 3212108 | 10/1986 | Fed. Rep. of Germany . |

OTHER PUBLICATIONS

German Office Action dated May 18, 1992 Die zentrale Kalteerzeugungsanlage des Bergwerks Heinrich Robert.

Pelton-Turbine, Rohraufgeber, Druckmengentauscher, By: Ing. (grad.) Edmond Tuttass, Gelsenkirchen.

*Primary Examiner*—Richard A. Bertsch
*Assistant Examiner*—Roland McAndrews, Jr.
*Attorney, Agent, or Firm*—Antonelli, Terry, Stout & Kraus

[57] ABSTRACT

A fluid pressure feeding apparatus for feeding cold water for cooling a mining pit into the pit and pumping water and muddy water heated within the mining pit onto the ground. A controller for switching a number of the operative chambers is provided to thereby perform a continuous operation.

4 Claims, 8 Drawing Sheets

FLUID PRESSURE FEEDING APPARATUS

BACKGROUND OF THE INVENTION

1, Field of the Invention

The present invention relates to a fluid pressure feeding apparatus for feeding cold water or ice slurry into a mining pit such as a diamond mine and a gold mine and pumping up warmed water or muddy water to the ground.

2. Description of the Prior Art

There is a conventional operating method for a fluid pressure feeding apparatus having a plurality of feeding chambers, which apparatus does not have a pressure detector. On the other hand, apparatus having a pressure detector is disclosed in South African patents Nos. 75/6967 and 82/0078.

The above-described prior art suffers the disadvantage in that for example, when one of the three feeding chambers is inoperative, the three feeding chamber must be stopped.

SUMMARY OF THE INVENTION

According to the present invention in view of this difficulty, there are provided a fluid pressure feeding apparatus having a plurality of feeding chambers some of which may be rendered inoperative by a switching control, and after a repair, the feeding chambers may be operated in the original operating number to thereby attain the continuous operation.

According to the present invention, a plurality of feed chambers are provided for connection at both ends with switching valves and pressure regulating valves, and for example, a four chamber operation using four feeding chambers, a three chamber operation using three feeding chambers and a two chamber operation using two feeding chambers or inversely an operation of an increased number of the chambers may be switched over without stopping the apparatus.

In a water piston type fluid pressure feeding apparatus comprising, for example, four switching valves respectively connected, to four feeding chambers and two pressure regulating values, when one of the feeding chambers is rendered inoperative during the four chamber operation, it is possible to switch the overall operation to a three chamber operation excluding the inoperative chamber, or when two of the four feeding chambers are inoperative, it is possible to switch the overall operation to a the two chamber operation excluding the inoperative chambers, thereby making it possible to continuously operate the apparatus without stopping the plant.

In the same manner, when one of the three feeding chambers is rendered inoperative during a three chamber operation, the operation is switched to the two chamber operation excluding the inoperative feeding chamber, thereby making it possible to continuously operate the apparatus without stopping the plant.

DESCRIPTION OF THE PREFERRED EMBODIMENTS

Figure 1:
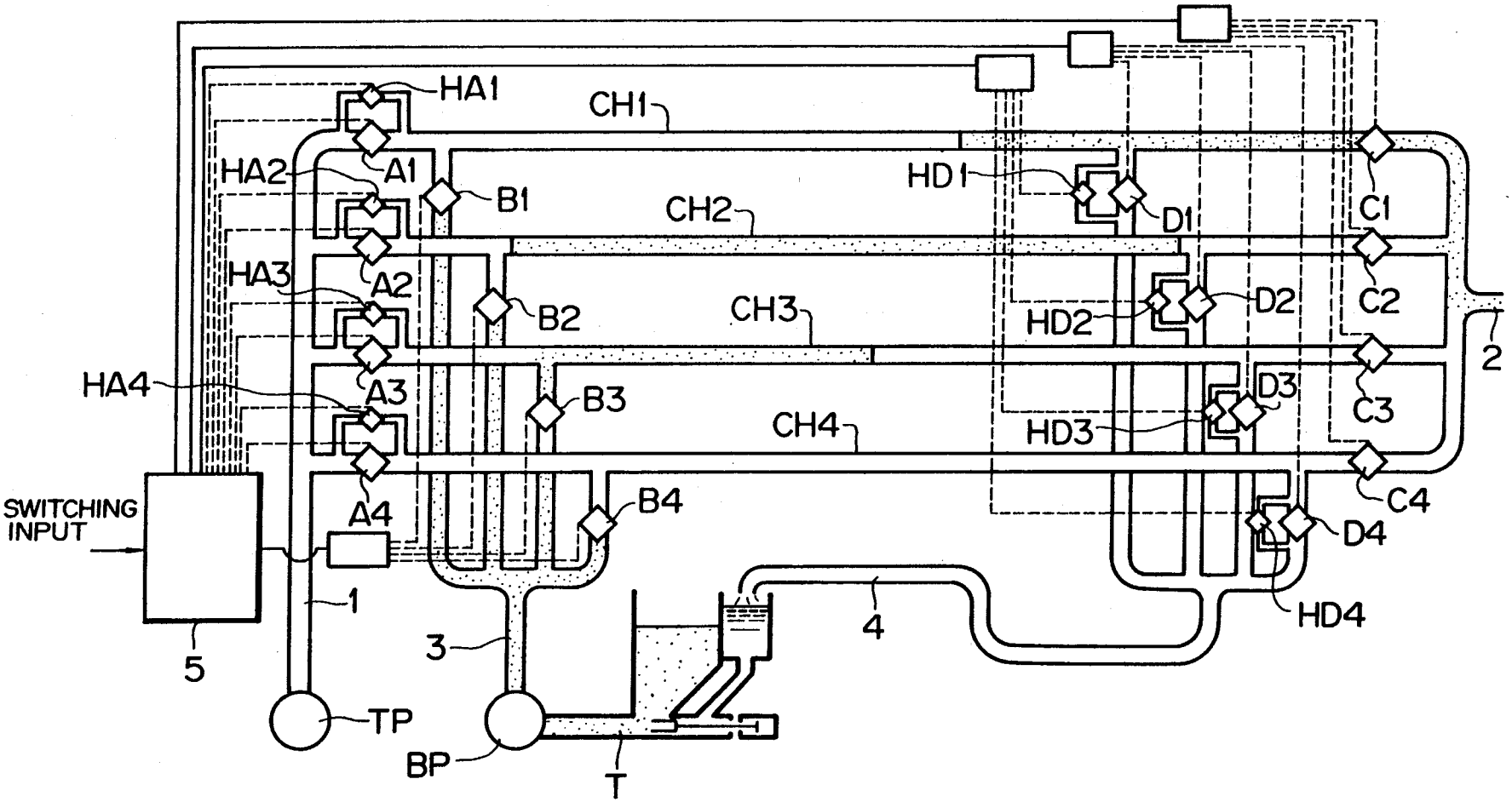
FIG. 1 is a systematic view showing a fluid pressure feeding apparatus having four feeding chambers according to one embodiment of the invention.
Figure 2:
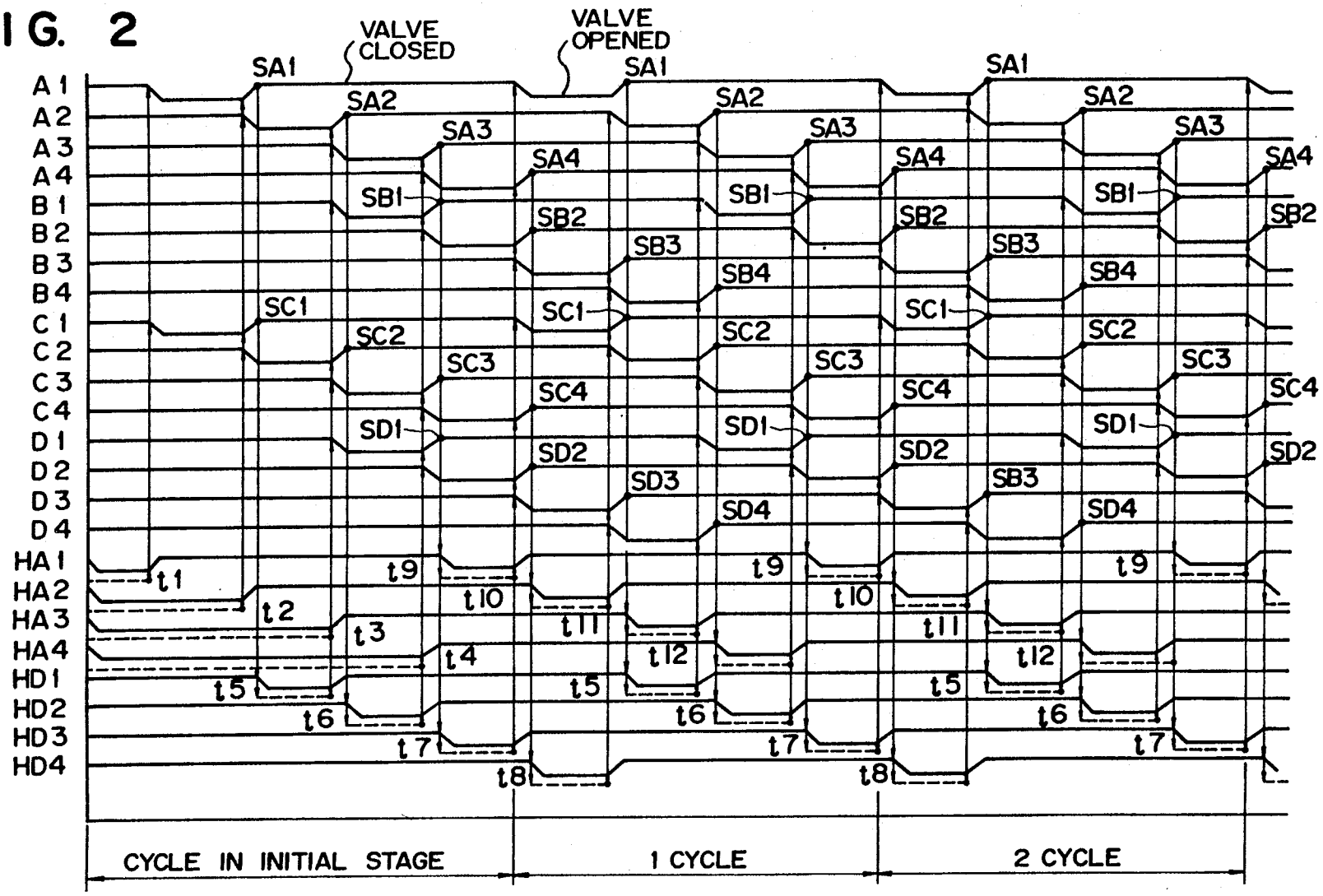
FIG. 2 is a time chart of the operation.
Figure 3:
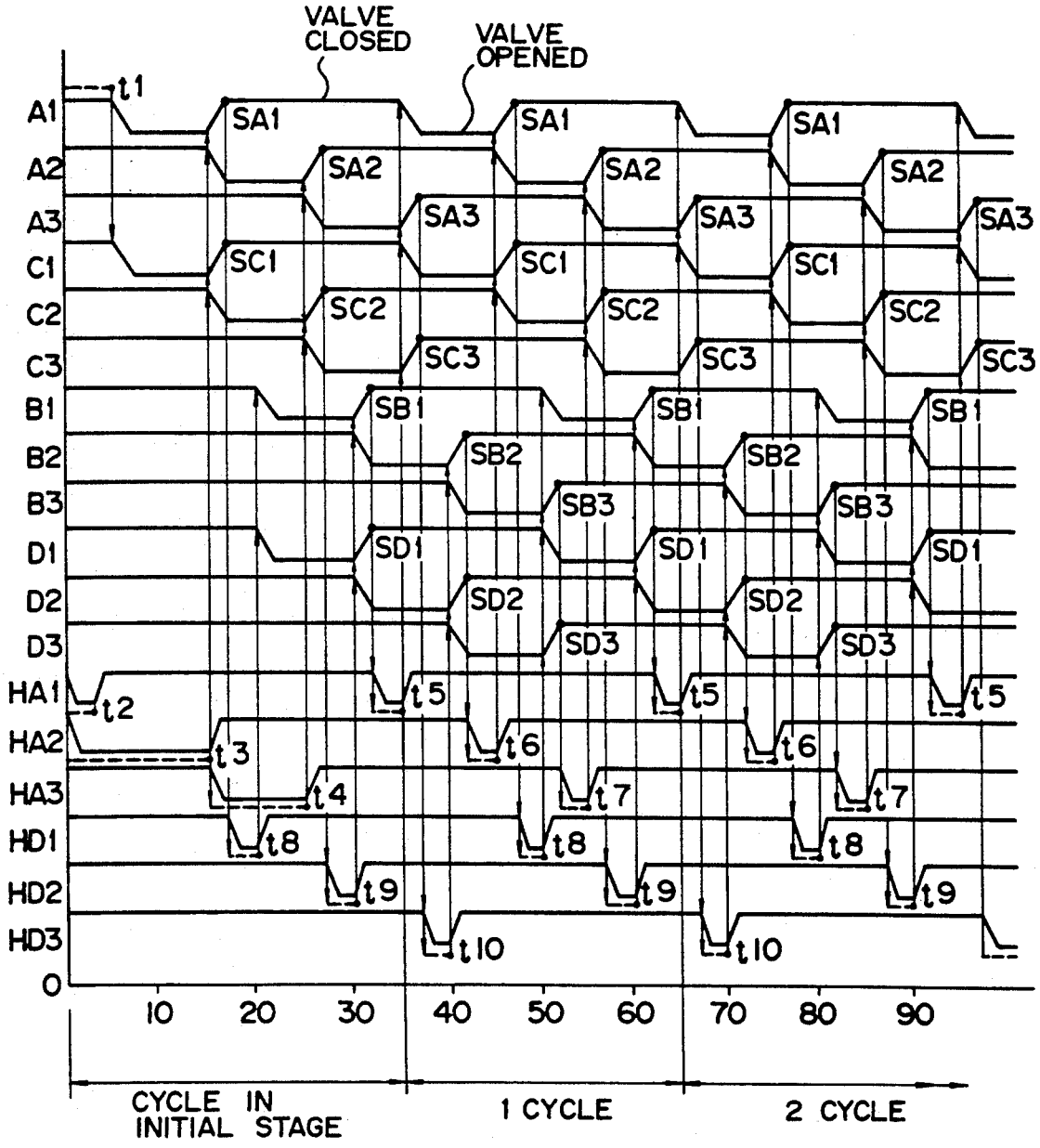
FIG. 3 is a time chart of the three chamber operation.
Figure 4:
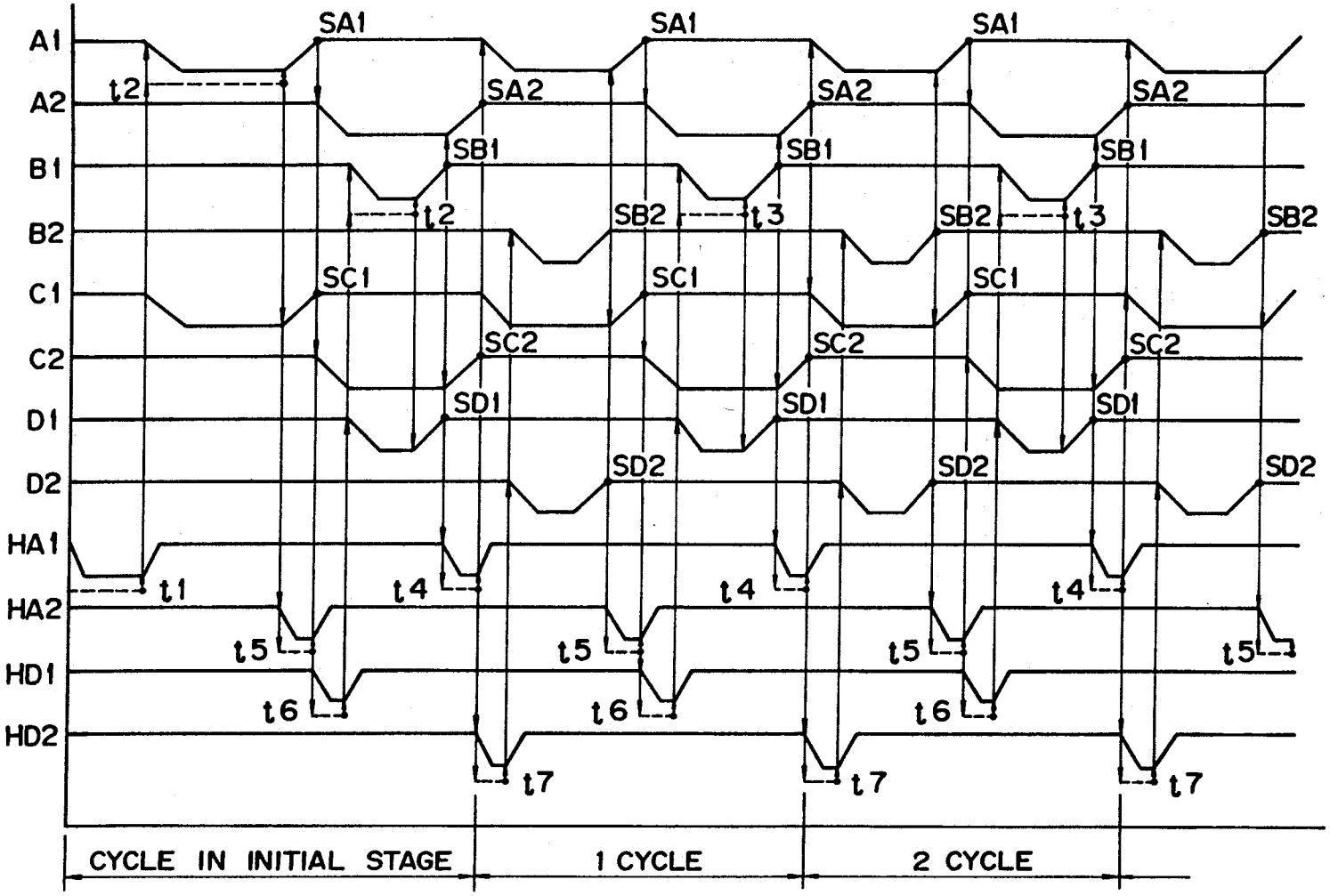
FIG. 4 is a time chart of the two chamber operation.

An embodiment of the present invention will now be described in connection with FIG. 1, wherein a turbine pump TP feeds clean water at a high pressure, and a slurry pump BP feeds, at a low pressure, a slurry from a slurry tank T of a slurry concentration adjusting apparatus. Feeding chambers CH1–CH4 receive the slurry at a low pressure and feed the slurry at a high pressure. Switching valves A1–A4, B1–B4, C1–C4 switch the flow for introducing/discharging the high pressure water in the feeding chambers, and pressure regulating valves HA1–HA4 and HD1–HD4 switch the pressure within the feeding chambers from the low pressure to the high pressure or from the high pressure to the low pressure.

In operation, when the feeding chamber CH1 is filled with the high pressure clean water, the valves A1 and C1 are closed. Subsequently, by opening the valve HD1, the pressure within the feeding chamber CH1 is switched from the high pressure to the low pressure and then the valve HD1 is closed.

Subsequently, by opening the valves B1 and D1, the slurry within the tank T is fed into the feeding chamber CH1 through the low pressure slurry pipe line 3 and the valve B1 by the low pressure slurry pump BP. At this time, the clean water within the feeding chamber CH1 is excluded through the valve D1 into the low pressure pipe line 4 by the low pressure slurry.

On the other hand, when the feeding chamber CH is filled with the slurry, the valves B1 and D1 are closed. Subsequently, the valve HA1 is opened so that the pressure within the feeding chamber CH1 is switched over from the low pressure to the high pressure. Further, the valve HA1 is closed.

Subsequently, the valves A1 and C1 are opened, the clean water is fed through the high pressure pipe line 1 and the valve A1 to the feeding chamber CH1 by the high pressure clean water pump TP. At this time, the slurry within the feeding chamber CH1 is discharged through the valve C1 to the high pressure slurry pipe line 2.

The above-described operation for the feeding chamber CH1 is also repeated for the feeding chambers CH2, CH3 and CH4.

The respective valves A1–A4, B1 to B4, C1 to C4, D1 to D4, HA1 to HA4, HD1 to HD4 are opened/closed by a controller 5 and hydraulic means (not shown).

The controller 5 functions to perform a six-way switching operation, i.e., a four chamber operation using four feeding chambers, a three chamber operation using three of the four feeding chambers, and a two chamber operation using two of the four feeding chambers, or inversely increasing the number of the operative chambers.

Assuming that the four chamber operation is normal, in the case where, for example, one or two feeding chambers are out of order, the three or two chamber operation is effected by excluding the inoperative feeding chambers to continuously perform the operation. The switching signal may be manually inputted into the controller 5.

Also, the switching may be performed automatically. For example, the inoperative feeding chamber is detected according to a pressure or a vibration thereof, and the detection signal thereof is inputted into the controller 5 for stopping the operation of the inoperative chamber.

The number of the operative feeding chambers is reduced by such a problem, and the damaged part of the feeding chamber due to the problem is repaired. After the repair, the operative number of feeding chambers is restored to the original number to perform the normal operation. As a result, it is unnecessary to completely stop a feeding device as is required in the prior art. The return order signal may be inputted into the controller 5.

In another embodiment, it is possible to use the three of the four feeding, chambers while one feeding chamber is used as a spare feeding chamber. If one of the operating feeding chambers suffers from a problem, then the operation is switched to the operation using the spare feeding chamber in addition to the other two operating feeding chambers to perform the continuous operation.

Furthermore, in the case where two of the three feeding chambers suffer from problems in the operation using three of the four chambers, it is possible to continue the operation by switching the operation to the two chamber operation in which the spare feeding chamber is operated in addition to the remaining operating feeding chamber.

Figure 5:
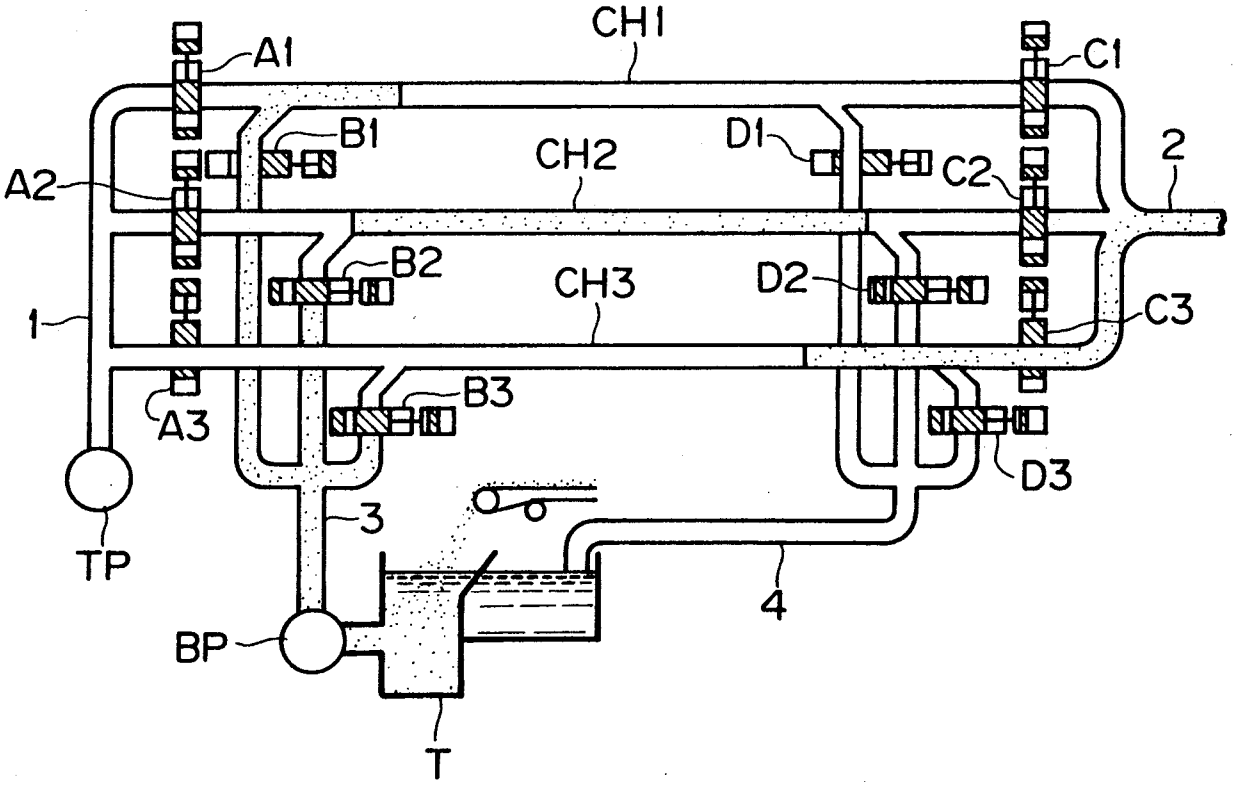
FIGS. 5 and 6 are views illustrating the application of the invention to a slurry transportation and a mining pit cooling/warming water transportation.

With the arrangement of FIG. 5 it is also possible to perform the operation while increasing/decreasing the number of the operative feeding chambers without stopping the operation by effecting the switching in the same way as that of the pressure feeding apparatus having the four feeding chambers in accordance with the controller (not shown).

Figure 6:
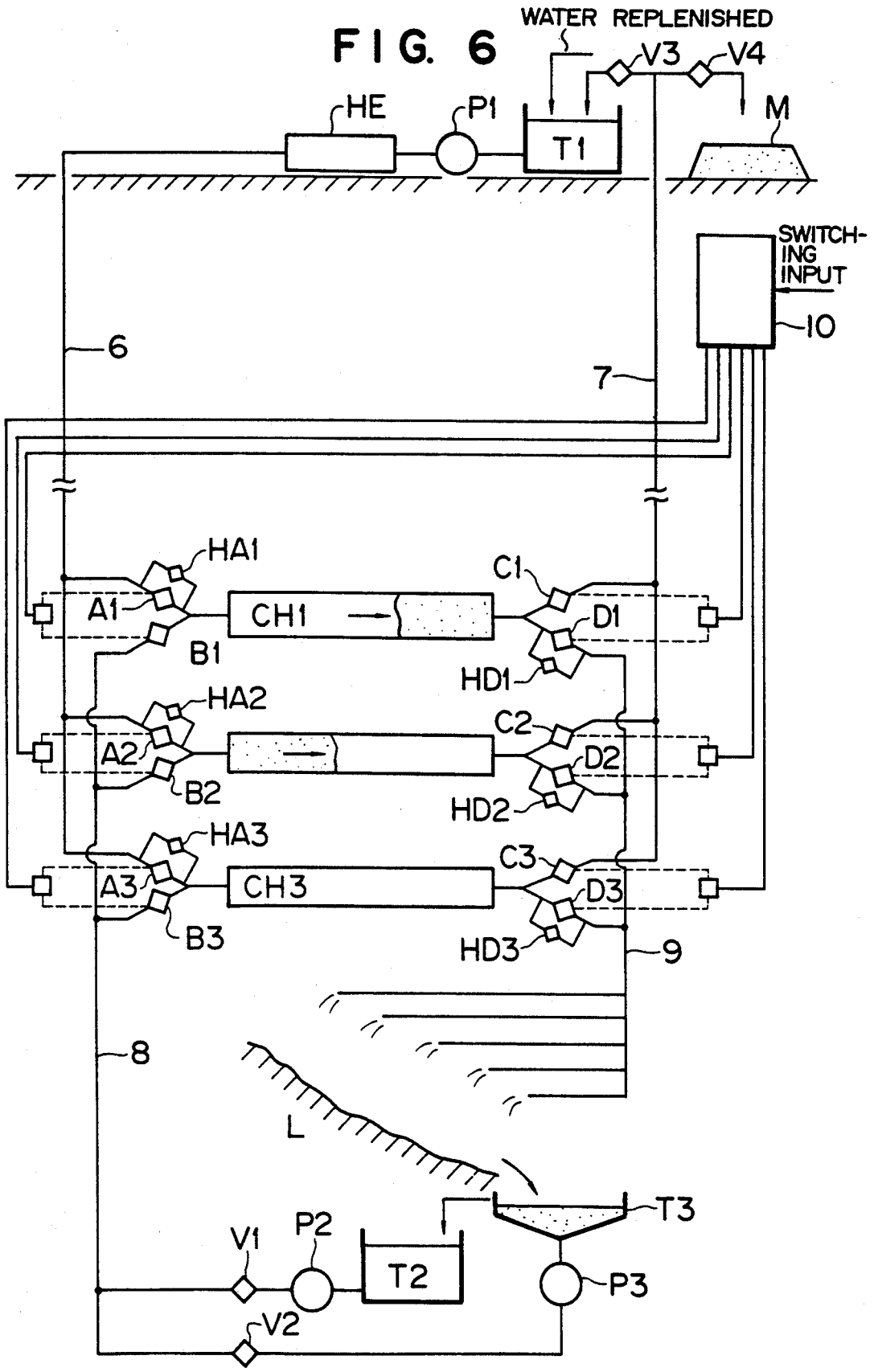

FIG. 6 shows an example of the application of the invention to a mining pit cooling cold water transportation using the fluid pressure feeding apparatus composed of three feeding chambers.

As shown in FIG. 6, a hot water tank T1 is provided on the ground, with a hot water pump P1 for feeding the hot water being accommodated in the hot water tank T1. The hot water pump P1 feeds the hot water into the mining pit through a refrigerator HE. The hot water passing through the refrigerator HE becomes cold water and is fed into the mining pit to a feeding chamber CH1 through a high pressure pipeline and a valve A1 provided within the mining pit. At this time, the valve C1 is opened, and the valves B1 and D1 are closed. Also the valves HA1 and HD1 are closed.

When the feeding chamber CH1 is filled with the cold water, the valves A1 and C1 are closed. Subsequently, the valve HD1 is opened so that the pressure within the feeding chamber CH1 is switched over from the high pressure to the low pressure and further the valve HD1 is closed.

Subsequently, the valves B1 and D1 are opened so that the hot water within the tank T2 is fed into the feeding chamber CH1 through the switching valve V1, the low pressure pipe line 8 and the valve B1 by the low pressure hot water pump P2. At this time, the cold water within the feeding chamber CH1 is extruded through the valve D1 to the outside of the feeding chamber CH1 by the hot water. Then, the cold water is introduced into the working site through the low pressure pipe lines 9.

When the feeding chamber CH1 is filled with the hot water, the valves B1 and D1 are closed. Subsequently, the valve HA1 is opened, the pressure within the feeding chamber CH1 is switched from low pressure to high pressure and further the valve HA1 is closed.

Subsequently, the valves A1 and C1 are opened, as mentioned before, the cold water is fed from the ground to the feeding chamber CH1. At this time, the hot water within the feeding chamber CH1 is discharged the valve C1 to the outside of the feeding chamber CH1 and is pumped up through the pipe line 7 and switching valve V3 to the hot water tank T1.

The switching operation is controlled in accordance with a switching signal output from the controller 10.

The cold water passing through the pipe lines 9 is sprayed over the working site L to absorb heat from thermal loads such as the atmosphere, machines and mining paths and to cool them. As a result the water becomes hot water.

At this time, the sprayed cold water dissolves therein a clayish component of rocky walls of the mining pit and becomes muddy hot water. The muddy hot water is separated into a muddy component and a hot water component in a precipitation tank T3. Only the hot water component is fed to the hot water tank T2 and fed to the feeding chambers CH through the above-described operation by the low pressure hot water pump P2.

The muddy slurry, precipitated in the precipitation tank T3 is supplied to the feeding chamber CH1 through the switching valve V2, the low pressure pipe line 8 and the valve B1 by the low pressure slurry pump P3 in the same manner as the hot water. At this time, the switching valve V1 is closed and the low pressure hot water pump P2 is stopped.

Accordingly, after the feeding chamber CH1 has been filled with the low pressure muddy slurry, the slurry is extruded into the high pressure pipe line 7 by the cold water in the same operational principle as when the pumping-up operation for the hot water.

In this embodiment, also, the operation for increasing/decreasing the operative chambers is performed in accordance with the controller (not shown).

Figure 7:
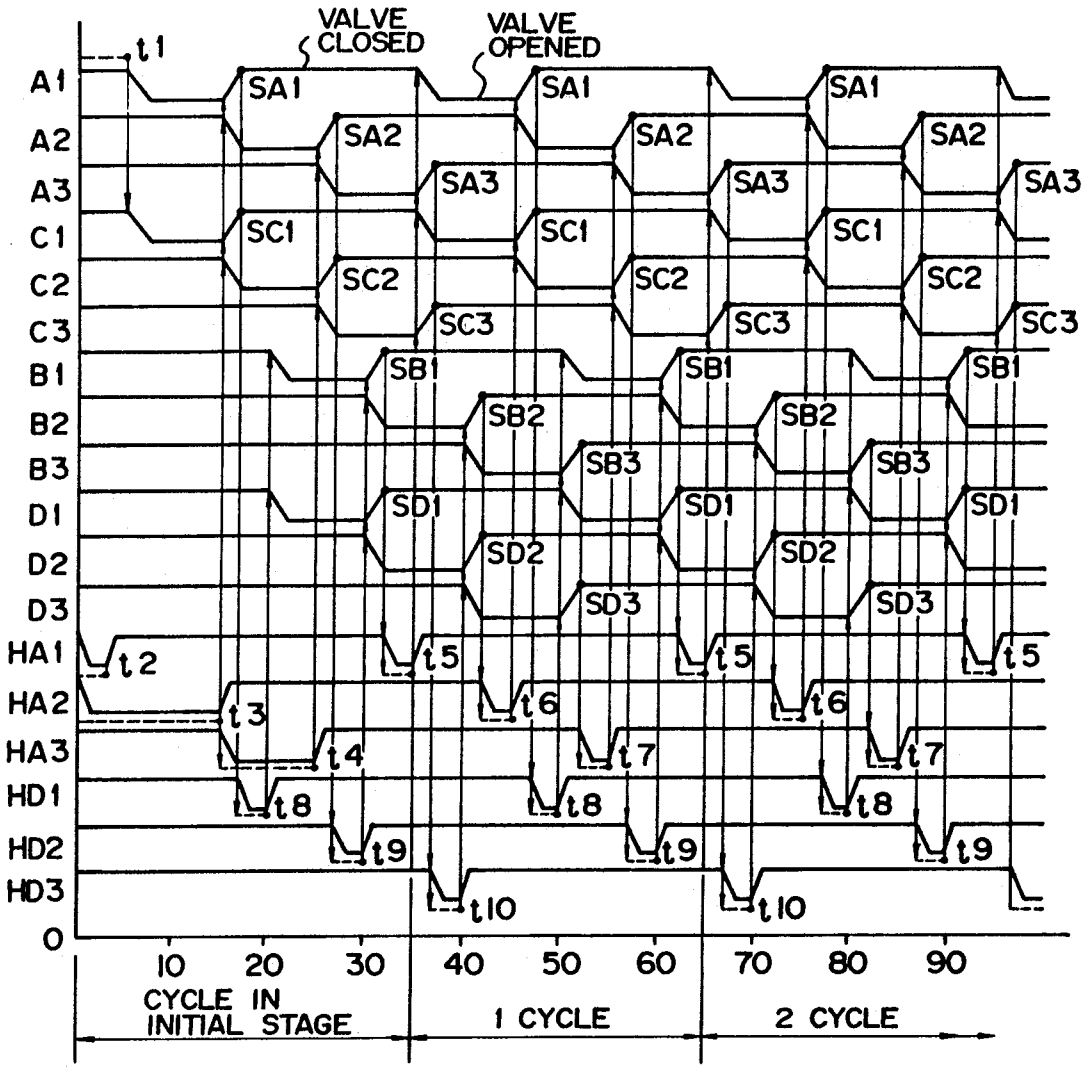
FIG. 7 is a time chart of the embodiment shown in FIG. 6.

In FIG. 7, the opened/closed condition of each valve is detected by a proximity switch and an opening/closing timing signal for the valve is given by a timer. Accordingly, the operational reliability is considerably enhanced in comparison with the other embodiments in which the control is effected by using a pressure switch (manometer with contacts) in accordance with the pressure condition within the feeding chamber CH.

In the foregoing embodiment, since the hot water and the muddy slurry may be pumped up from the mining pit to the ground by utilizing the positional energy for feeding the cold water from the ground with the pump installed within the mining pit, it is unnecessary to keep the muddy slurry pump at a high pressure, and by the reduction of the pressure, an initial cost for the slurry pump may be reduced. Also, the maintenance cost for the slurry pump may be reduced and the power consumption of the slurry pump may be reduced.

Since the high pressure pipe for pumping the hot water from the mining pit to the ground may be also used as a muddy water transportation pipe, it is possible to reduce the initial costs such as material cost, the construction cost and installation cost of the high pressure pipe line and to reduce the maintenance cost of the high pressure pipe line.

Figure 8:
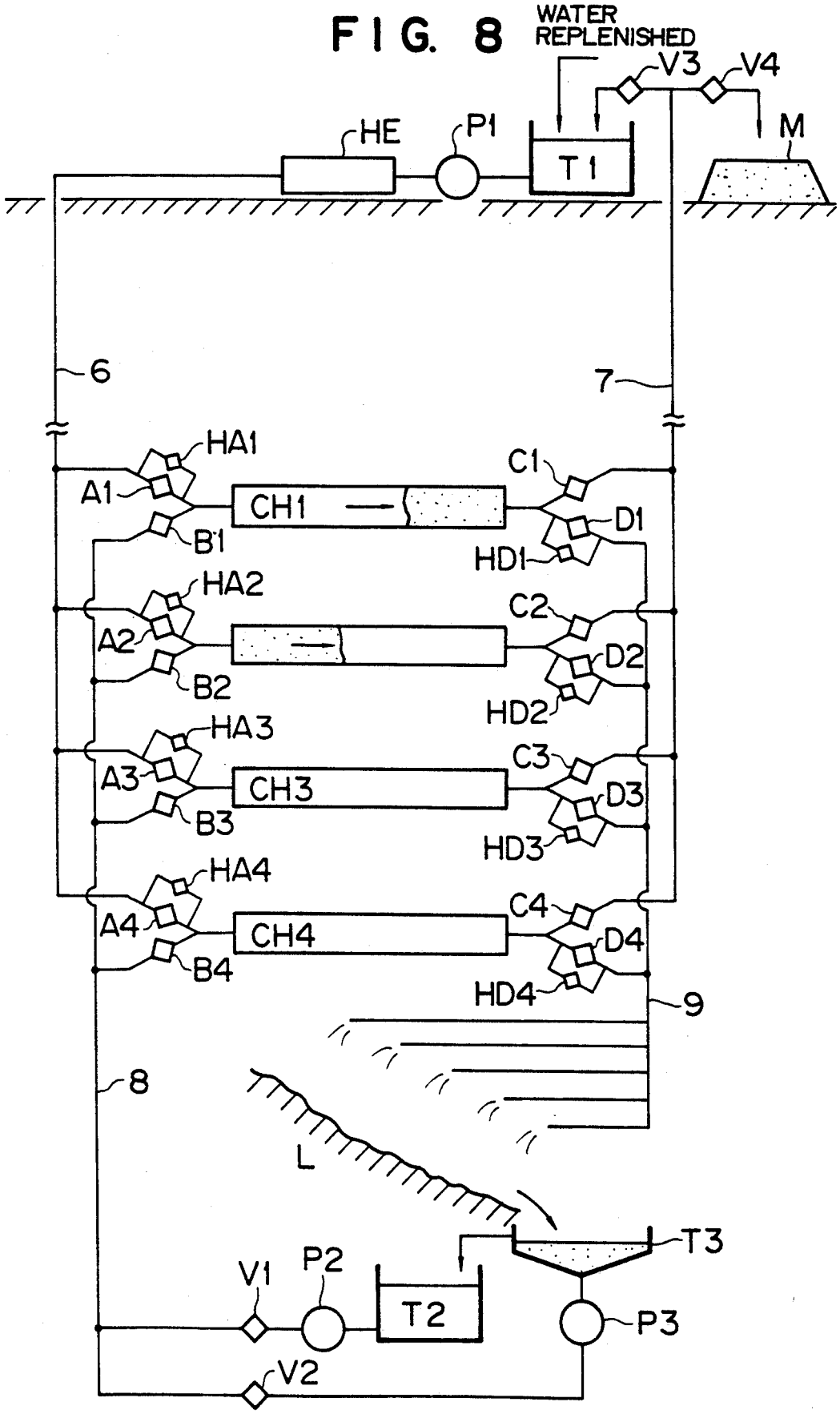
FIG. 8 is a view showing an application of the invention to a mining pit cooling/warming water transportation.

FIG. 8 shows the application of the invention to the mining cooling/hot water transportation system using the four chamber type water piston fluid pressure feeding apparatus composed of four feeding chambers. In this embodiment, the operation for increasing/decreasing the number of the operative chambers may be performed by a signal from the controller (not shown).

We claim:

1. A fluid pressure feeding apparatus having a plurality of feeding chambers and switching valves connected to opposite ends of each of said feeding chambers, said fluid pressure feeding apparatus comprising control means for controlling an initial number of operating chambers of said plurality of feeding chambers in accordance with an initial predetermined time chart to thereby continue an operation of the feeding apparatus, wherein said control means is adapted to switch the switching valves in response to an increase/decrease in the number of the operating chambers in accordance with a further predetermined time chart, whereby the operating chambers are operated in accordance with the further predetermined time chart in dependence upon the increase/decrease of the number of operating chambers.

2. A fluid pressure feeding apparatus having a plurality of feeding chambers and switching valves connected to opposite ends of each of said feeding chambers, said fluid pressure feeding apparatus comprising control means for controlling a number of operating chambers of said feeding chambers in accordance with an initial predetermined time chart, wherein the control means is adapted to switch the switching valves connected to said feeding chambers in accordance with a further predetermined time chart for continuing the operation of the pressure feeding apparatus when at least one of the feeding chambers is disabled, while operating the remaining feeding chambers.

3. A fluid pressure feeding apparatus having a plurality of feeding chambers and switching valves connected to opposite ends of each of the feeding chambers, said fluid pressure feeding apparatus comprising control means for controlling a number of operating chambers of said feeding chambers, said feeding chambers including a first operating chamber and a further feeding chamber operable only when at least one of said first operating chambers is disabled, and wherein, when at least one of the first operating feeding chambers is disabled, said control means switches the switching valves for continuously operating the apparatus with the remainder of the first operating chambers and the further feeding chamber of the disabled first operating chamber in accordance with a predetermined time chart.

4. A fluid pressure feeding apparatus having a plurality of feeding chambers and switching valves connected to opposite ends of each of the feeding chambers, control means for controlling an operation of a number of operating chambers of said feeding chamber in accordance with an initial predetermined time chart, wherein, when at least one of the feeding chambers is disabled, the switching valves connected to the remaining feeding chambers are switched for continuing an operation of the fluid pressure feeding apparatus with the remainder of the feeding chambers in accordance with a further predetermined time chart, and wherein said control means switches the switching valves of the feeding chambers in accordance with the initial predetermined time chart for continuing the operation of the fluid pressure feeding apparatus when the at least one disabled feeding chamber becomes operable.

* * * * *